US009856074B2

(12) United States Patent
Petty et al.

(10) Patent No.: US 9,856,074 B2
(45) Date of Patent: Jan. 2, 2018

(54) BAKED GOODS BOX

(71) Applicant: Indiana Carton Company, Inc., Bremen, IN (US)

(72) Inventors: James C Petty, Edwardsburg, MI (US); Brenna D Zbieranski, Bremen, IN (US); Matthew W Petty, Granger, IN (US)

(73) Assignee: Indiana Carton Company, Inc., Bremen, IN (US)

( * ) Notice: Subject to any disclaimer, the term of this patent is extended or adjusted under 35 U.S.C. 154(b) by 0 days.

(21) Appl. No.: 14/846,237

(22) Filed: Sep. 4, 2015

(65) Prior Publication Data

US 2017/0066586 A1 Mar. 9, 2017

(51) Int. Cl.

| | |
|---|---|
| ***B65D 85/36*** | (2006.01) |
| ***B65D 5/42*** | (2006.01) |
| ***B65D 5/66*** | (2006.01) |
| ***B65D 5/20*** | (2006.01) |

(52) U.S. Cl.
CPC ..... *B65D 85/36* (2013.01); *B65D 5/4204* (2013.01); *B65D 5/6667* (2013.01)

(58) Field of Classification Search
CPC .... B65D 5/4216; B65D 5/106; B65D 5/4204; B65D 5/4266; B65D 5/56; B65D 85/14; B65D 5/48014; B65D 5/029; B65D 2571/00845; B65D 85/36; B65D 5/2052; B65D 5/6602
USPC ..... 229/116.1, 87.19, 922, 120.18, 162.7, 229/120.12, 162.1, 162.3, 120.08, 145; 206/736, 457, 783; 220/376; D9/418
See application file for complete search history.

(56) References Cited

U.S. PATENT DOCUMENTS

| | | | | |
|---|---|---|---|---|
| 2,844,473 A * | 7/1958 | Seiferth | B65D 5/28 | 229/108 |
| 3,019,958 A * | 2/1962 | Asman | B65D 5/667 | 206/807 |
| 5,271,552 A * | 12/1993 | McDonnell | B65D 5/4204 | 229/162.7 |
| 8,523,049 B2 * | 9/2013 | Fitzwater | B65D 5/4204 | 229/114 |
| 2004/0182917 A1 * | 9/2004 | Watson | B65D 5/4212 | 229/162.7 |

* cited by examiner

*Primary Examiner* — Christopher Demeree
(74) *Attorney, Agent, or Firm* — Botkin & Hall, LLP

(57) ABSTRACT

A folding baked goods box that has a lower box portion having upstanding walls including a back wall that has a lower window edge. A lid portion of the box is hingedly attached to the lower box at the back wall. The top includes oppositely located lateral window edges that define lateral sides of a window. The lid portion includes a lid front that extends downwardly from the top and has a lower window edge is located within the front. The window in the baked goods box extends continuously from the lower window edge of the back wall across the top of the lid portion, between lateral window edges to the lower window edge of the front of the lid portion. The lid portion is adapted for being fitted over the lower box portion.

4 Claims, 5 Drawing Sheets

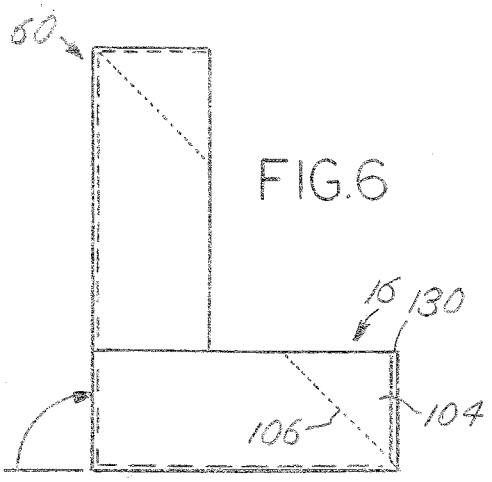
FIG.6
FIG.8
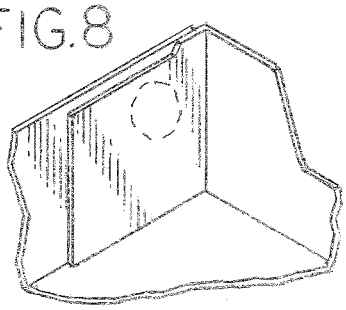
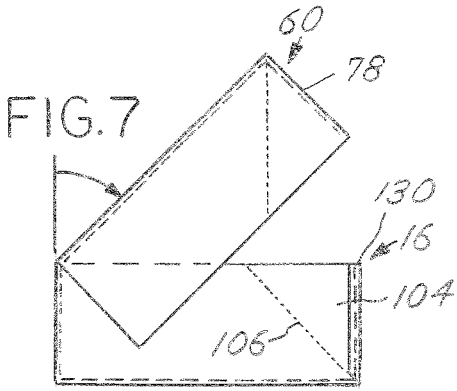
FIG.7
FIG.9
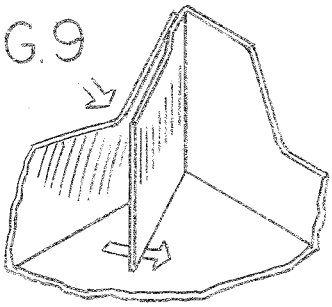
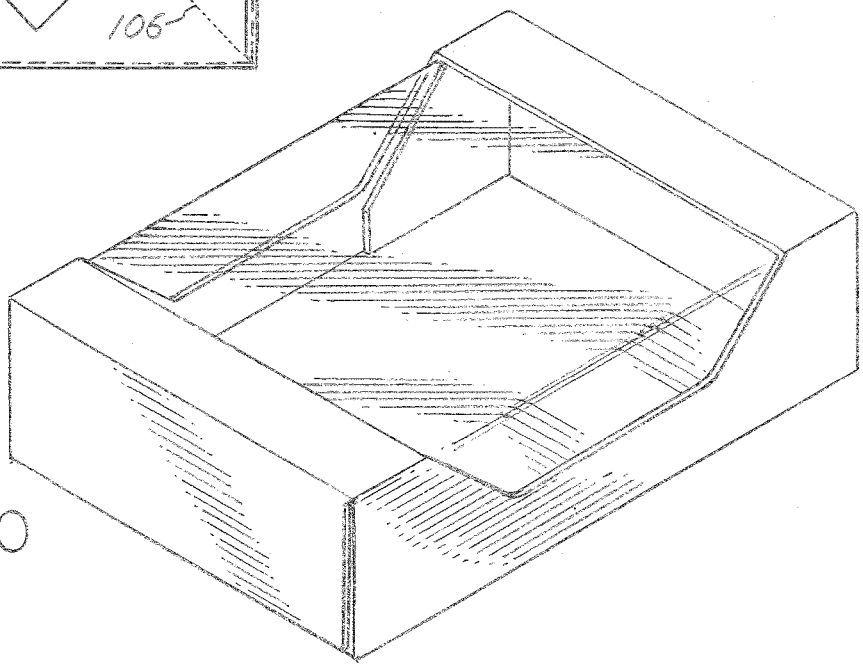
FIG.10

BAKED GOODS BOX

BACKGROUND OF THE INVENTION

When a consumer is shopping for baked goods, packaging is important. Having a good view of the product to be purchased is a significant aspect of why a consumer chooses a particular product as well as the condition of the product when it is viewed. The packaging must protect the baked goods within it from being damaged during their time in a retail location and during transit to a consumer's end destination for the product. Often, a viewing window is included in the packaging to assure a consumer that the product they are about to purchase is what they want and in good condition. However, in the past, such viewing windows did not provide full awareness of a box's contents. Having a large viewing area for such a window is a desirable characteristic for a baked goods box.

SUMMARY OF THE INVENTION

The present invention is a folding baked goods box. The baked goods box of the present invention has a lower box portion that has a bottom defined by a first transverse crease, a second transverse crease, a first lateral crease, and a second lateral crease. A first lower side wall extends from the first lateral crease and terminates in an upper edge, The first lower side wall is foldable to an upstanding position with respect to the bottom. A second lower side wall extends from the second lateral crease and terminates in an upper edge. The second lower side wall is foldable to an upstanding position with respect to the bottom. A lower front wall extends from the first transverse crease and terminates in an upper edge. The lower front wall has a lower front edge that is between the first crease and its upper edge. A back wall extends from the second transverse crease and terminates in an upper edge that is defined by third and fourth transverse creases. The back wall has a lower window edge that is between the third and fourth transverse creases and the second transverse crease. The lower front wall and the back wall are foldable to an upstanding position with respect to the bottom.

A lid portion of the box is attached to the lower box portion by the third and fourth transverse creases. The lid portion has a top defined by the third and fourth transverse creases, oppositely located fifth and sixth transverse creases, and third and fourth lateral creases. The top includes oppositely located lateral window edges that are located between the third and fourth lateral creases. The lid portion includes a lid front that extends from the fifth and sixth transverse creases and terminates at a lower edge that is opposite the fifth and sixth transverse creases. A lid lower window edge is located between the fifth and sixth transverse creases and the lid lower edge. The lid includes a first lid side wall that extends from the third lateral crease to a lower edge and a second lid side wall that extends from the fourth lateral crease to a lower edge.

A window in the baked goods box extends continuously from the lower window edge of the back wall across the top of the lid portion, between lateral window edges to the lower window edge of the front of the lid portion. The lid portion is adapted for being fitted over the lower box portion.

BRIEF DESCRIPTION OF THE DRAWINGS

FIG. 6 is a side view of the box in FIG. 5;

FIG. 7 is a side view of the box in FIG. 6 more nearly closed than in FIG. 6;

FIG. 8 shows a magnified corner of the lower box portion from the inside in its upstanding position; and FIG. 9 shows the view of FIG. 8 with the angled crease in the side wall bent inward and;

FIG. 10 shows a perspective view of the box in FIGS. 1-9 with the lid portion fitted over the lower box portion.

DESCRIPTION OF THE PREFERRED EMBODIMENT

Figure 1:
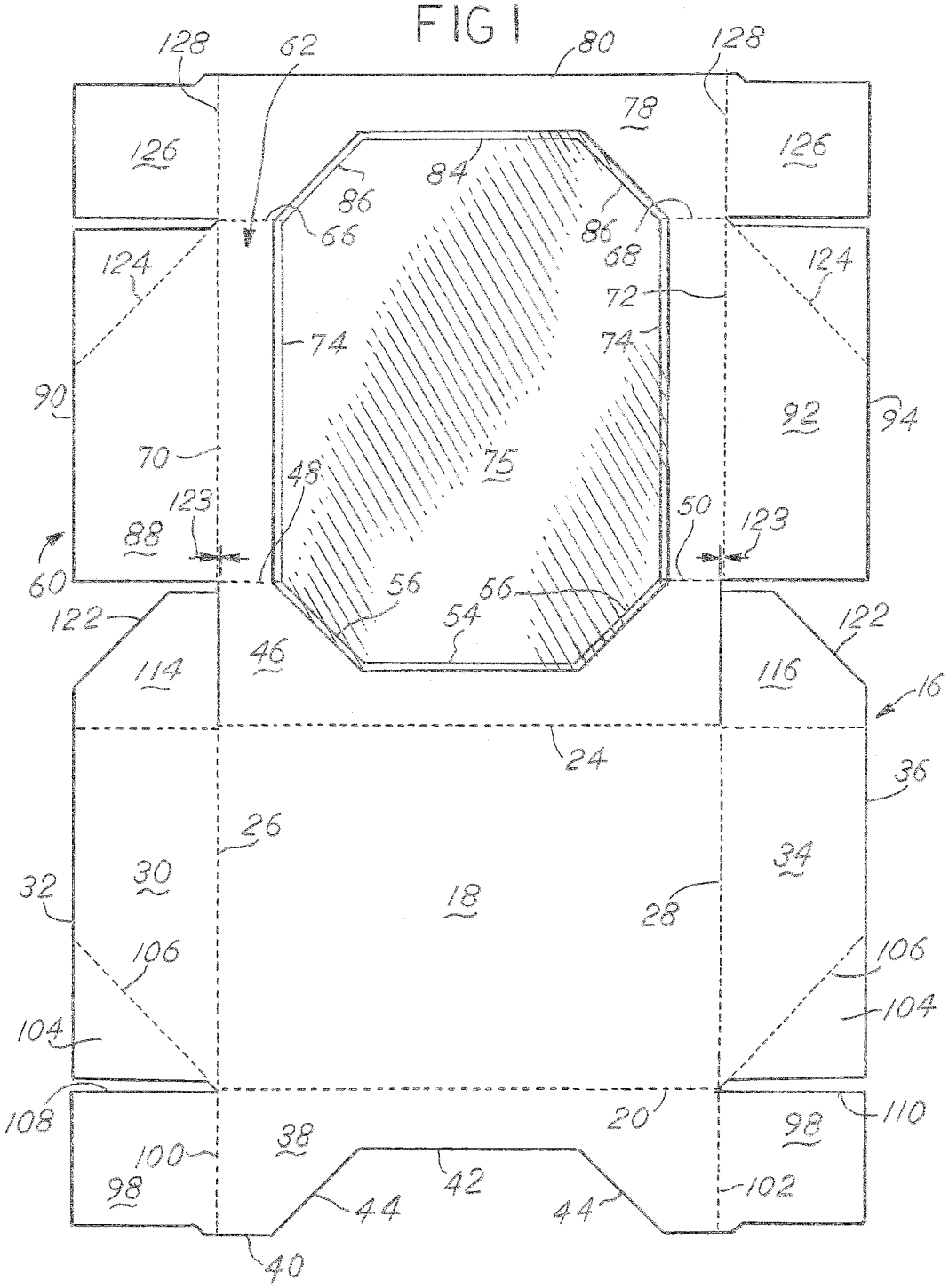
FIG. 1 is a flat unfolded cut and crease layout of the box of the present invention.
Figure 2:
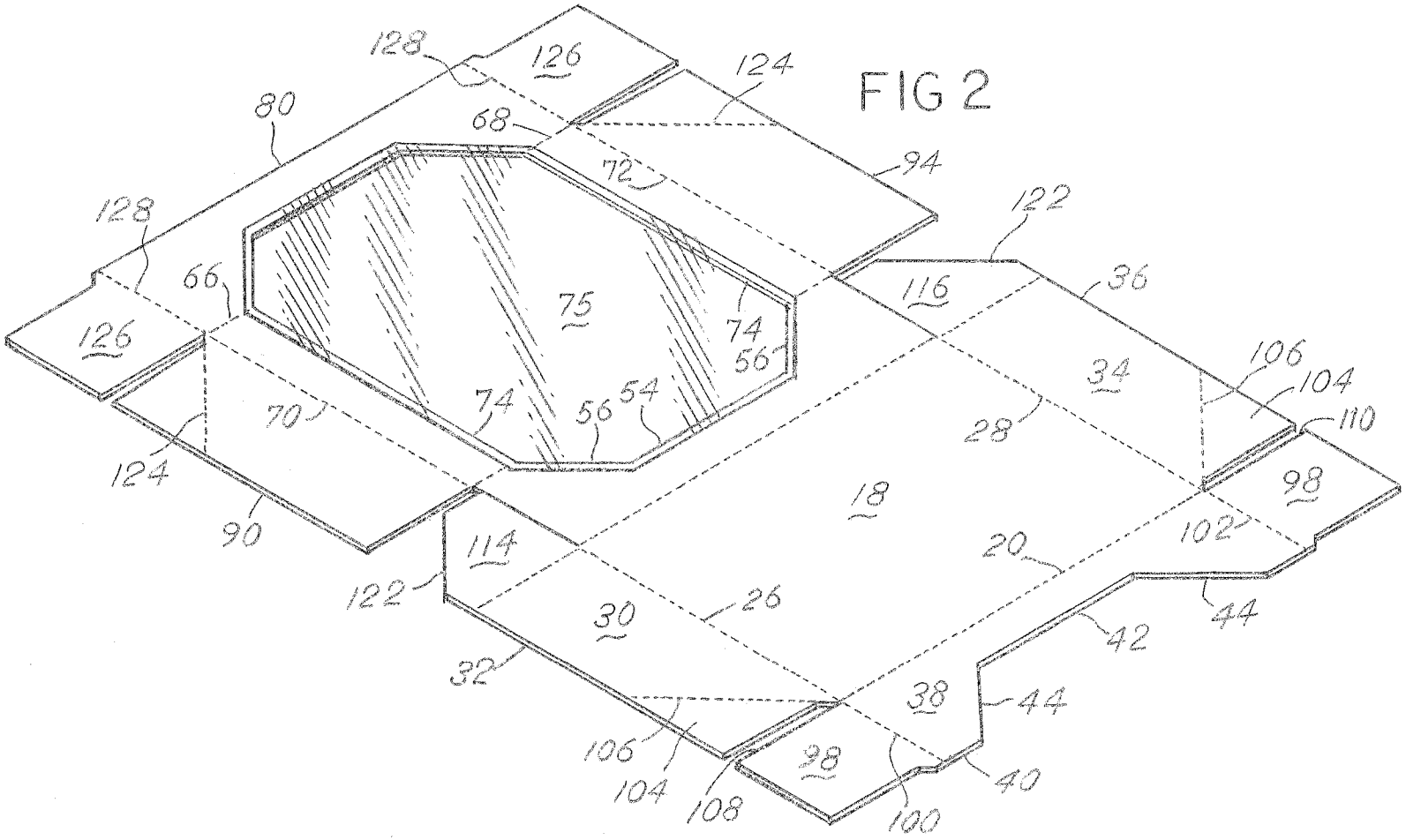
FIG. 2 is a perspective of the box in FIG. 1 in its unfolded state.

FIG. 1 shows a cut layout of the box 10 of the present invention in its flat and pre-assembled form. The box has a lower box portion 16 with a bottom 18 that is defined by a first transverse crease 20, a second transverse crease 24, a first lateral crease 26 and a second lateral crease 28. A first lower side wall 30 extends from the first lateral crease 26 and terminates in an upper edge 32. The first lower side wall 30 is foldable to an upstanding position with respect to the bottom 18. This upstanding position is show in FIGS. 3-5. In the upstanding position, the upper edge 32 is located above the bottom 18. A second lower side wall 34 extends from the second lateral crease 28 and terminates in an upper edge 36. The second lower side wall 34 has an upstanding position that, like the first lower side wall 30, locates its upper edge 36 above the bottom 18.

Figure 3:
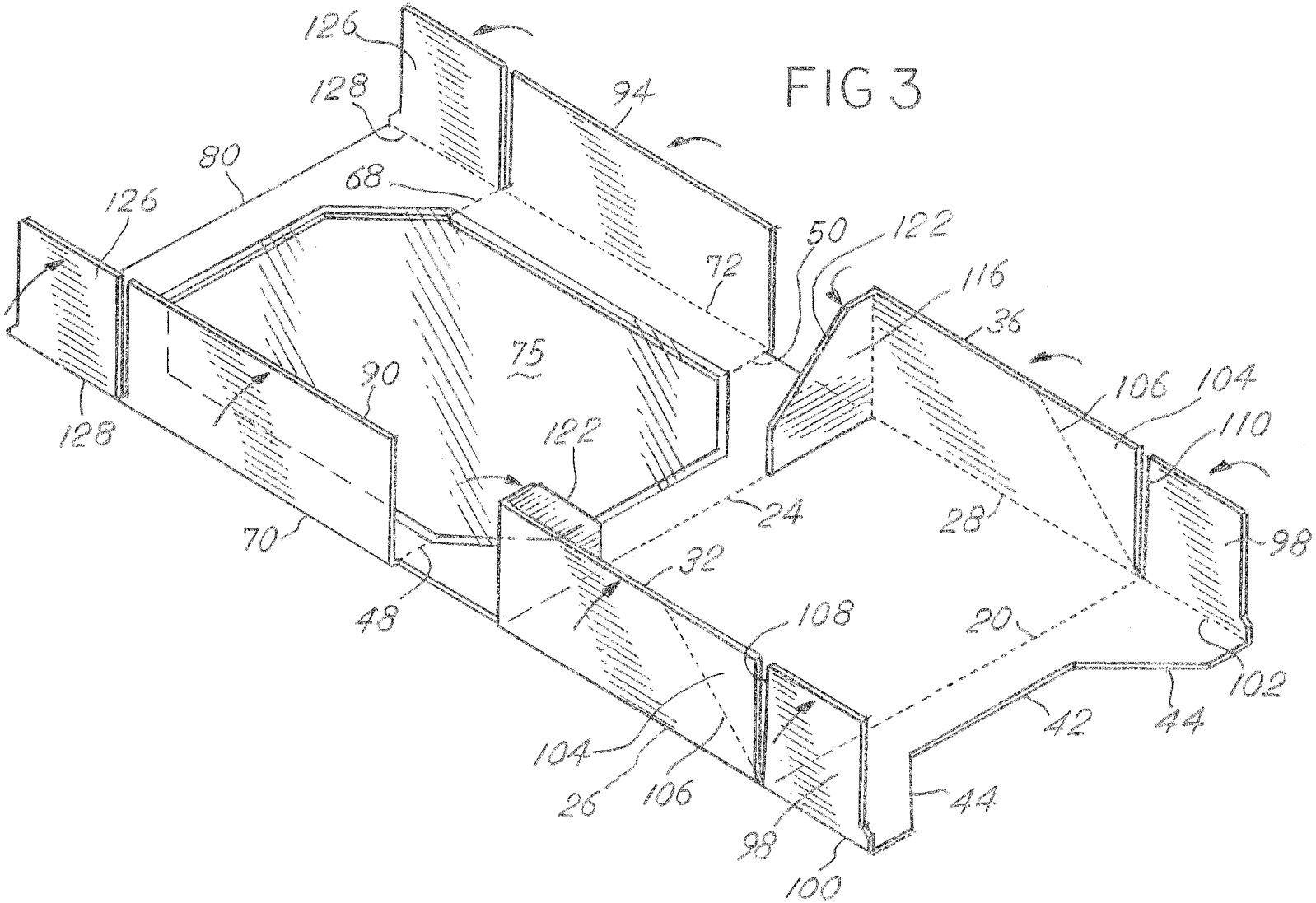
FIG. 3 the partially folded box as shown in FIGS. 1 and 2.
Figure 4:
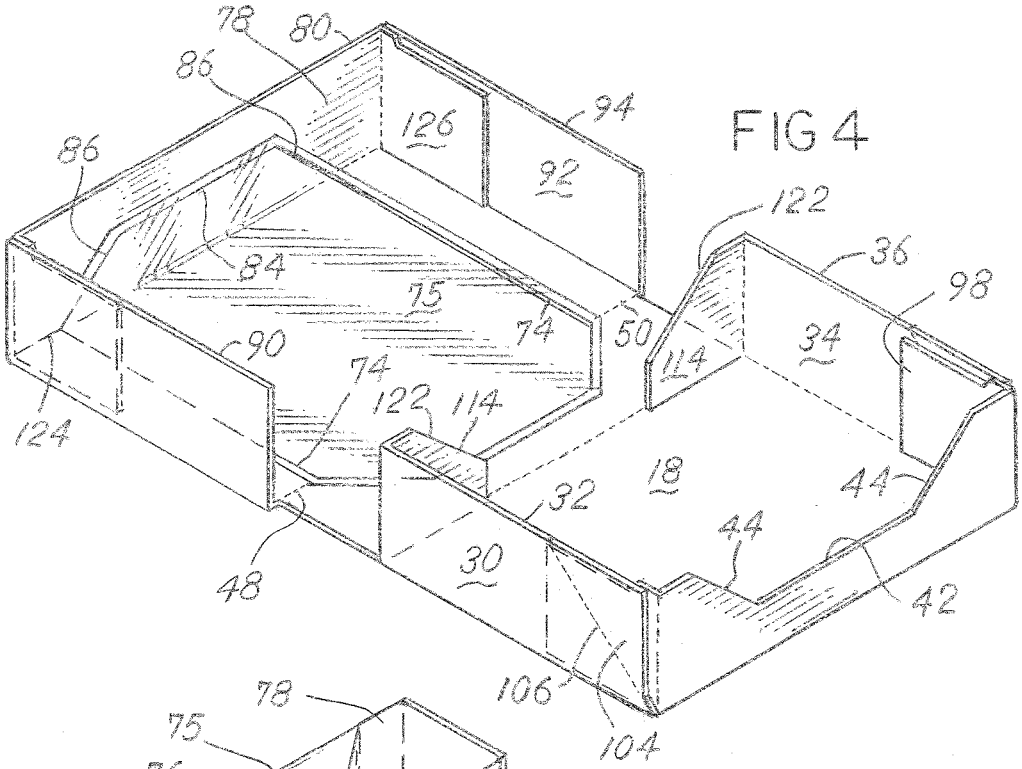
FIG. 4 is the box of the previous FIGS. shown in its folded state with the lid portion not fitted over the lower box portion.
Figure 5:
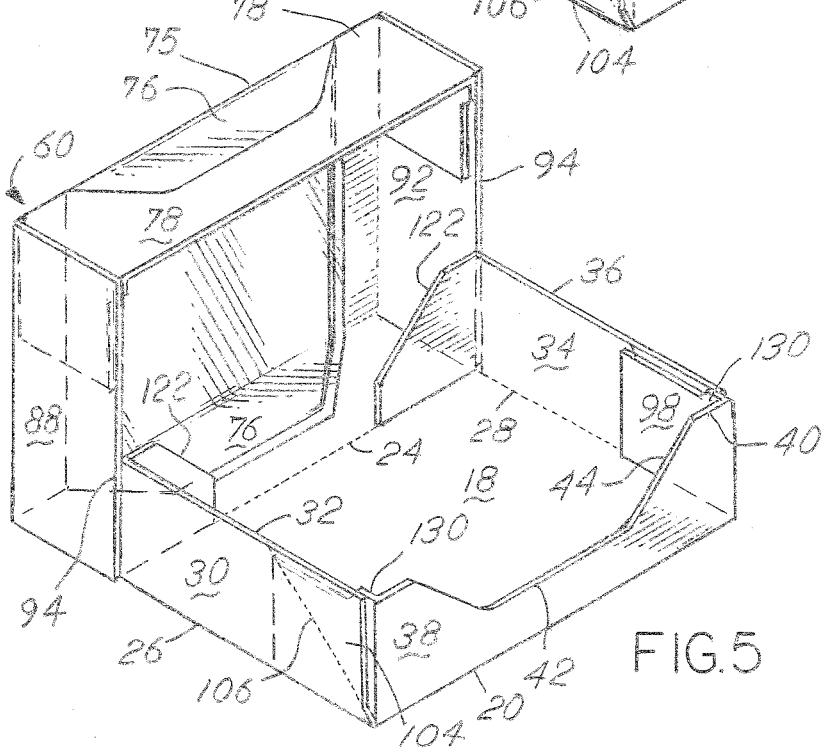
FIG. 5 is the box of the previous FIGS. with the lid portion partially folded toward being fitted over the lower box portion.

A lower front wall 38 extends from the first transverse crease 20 and terminates in an upper edge 40. The lower front wall 38 has an upstanding position that is shown in FIGS. 3-5 that locates the upper edge 40 above the bottom 18. The lower front wall 38 has a lower front edge 42 that is located between the upper edge 40 and the first transverse crease 20. The lower edge 40 is adjoined by angled edges 44 extending upwardly to the upper edge 40.

A back wall 46 extends from the second transverse crease 24 and terminates in at third and fourth transverse creases 48, 50. The third and fourth transverse creases 48, 50 are collinearly aligned. The back wall 46 has an upstanding position that is shown in FIGS. 3-5 that locate the third 48 and fourth 50 transverse creases above the bottom 18. The back wall 46 has a lower window edge 54 that is located between the third 48 and fourth 50 transverse creases and the second transverse crease 24. The lower window edge 54 is adjoined by angled window edges 56 that continue from the lower window edge 54 up to the third 48 and fourth 50 transverse creases.

A lid portion 60 is hingedly attached to the lower box portion 16 by the third and fourth transverse creases 48, 50. The lid portion has a top 62 that is defined by the third and fourth transverse creases 48, 50, oppositely located fifth and sixth transverse creases 66, 68, and third and fourth lateral creases 70, 72. The top 62 has lateral window edges 74 that are located between the third and fourth lateral creases 70, 72. The lid portion 60 has a lid front 78 that extends from the fifth and sixth transverse creases 66, 68 and terminates in a lower edge 80. The lid front 78 has a lid lower window edge 84 that is located between the fifth and sixth transverse creases 66, 68 and the lower edge 80. The lower window edge 84 is adjoined by angled window edges 86 that continue from the lower lid window edge 84 to the fifth and sixth transverse creases 66, 68. The baked goods box 10 has a window 75 that continues from the lower window edge 54 of the back wall 46 to the lower window edge 84 of the lid front 78 and is bordered by angled window edges 56, 86 and lateral window edges 74. A clear membrane 76, as best seen in FIG. 5 is secured behind the window 75 to protect the contents of the box 10. The lid 60 has a first lid side wall 88 that extends from the third lateral crease 70. The first lid side wall 88 terminates in a lower edge 90. A second lid side wall 92 extends from the fourth lateral crease 72 and terminates in a lower edge 94.

Assembly of the box 10 is facilitated by folding the lower front wall 38 into its upstanding position with respect to the bottom 18. The lower front wall 38 has front wall flaps 98 that extend from fifth and sixth lateral creases 100, 102. It is also contemplated that flaps could extend from lower box side walls 30, 34 and be adapted to attach to the lower front wall 38. In the box 10 shown in FIG. 4, the lower front wall flaps 98 are glued to lower side walls 30, 34. The lower front wall flaps 98 are glued to the lower side walls 30, 34 at specific locations that are within bottom lateral triangles 104. The adhesive location is shown most clearly in FIGS. 8 and 9 at 105. The bottom lateral triangles 104 are formed by their corresponding upper edge 34, 36, depending on the side that the respective triangle 104 is on, and an angled crease 106 that extends upwardly from the bottom 18. As shown in FIG. 4, the angled creases 106 are a perforated crease and this facilitates easy folding about the angled creases 106. The angled creases 106 are angled at an oblique angle with respect to the bottom 18 when the lower side walls 30, 34 are in their upstanding positions. Each of the lower front wall flaps 98 has a lower edge 108, 110 that faces the bottom 18 when the lower front wall 38 is in its upstanding position. The lower edges 108, 110 are located in such a way that there is an interference fit with the bottom 18 when the angled creases 106 are unbent and the bottom lateral triangles 104 are coplanar with their corresponding lower side walls 30, 34. This interference fit relationship is shown in FIG. 4 and is fixed by the adhesive bonding corresponding front wall flaps 98 to their respective bottom lateral triangle 104. As the angled creases 106 are bent inward, the lower edges 108, 110 drag along the bottom 18 and this drag prevents the box 10 from collapsing in once it is in the position shown in FIG. 4.

The lower side walls 30, 34 include back wall flaps 114, 116. These back wall flaps 114, 116 extend from seventh and eighth transverse creases 118, 120 on the lower side walls 30, 34. The back wall flaps 114, 116 are foldable to a perpendicular condition with respect to their corresponding lower side walls 30, 34 into the position shown in FIG. 4. Each of the back wall flaps 114, 116 has an angled edge 122 that is angled in such a manner that it does not obscure the window 75. The window 75 is unobstructed because the angled edges 122 of the back wall flaps 114, 116 are nearer the bottom 18 than the angled window edges 56.

The lid 60 is located into its fitted position over the lower box portion 16 by first folding the back wall 46 to its upstanding position about the second transverse crease 24. Once the back wall 46 is in its upstanding position, the lid 60 pivots about its third and fourth transverse creases 48, 50 that act as live hinges so the lid 60 can hinge over the lower box portion 16. The third and fourth lateral creases 70, 72 are offset outwardly of the first and second lateral creases 26, 28 by an amount equal or greater than the thickness of the material making up the lower box portion 16 so that the lid 60 fits over the lower box portion 16. Without the offset 123, fitting the lid 60 over the lower box portion 16 would likely cause the lower front wall 38 to partially collapse or bend inwardly. This would be detrimental to the cake or other baked goods stored within the box 10 because of the potential damage the lower front wall 38 could inflict on the product contained within the box 10.

FIG. 7 shows how the lid 60 hinges over the lower box portion 16. As the lid 60 is hinged downwardly as shown in FIG. 7, the third and fourth transverse creases 48, 50 that act as live hinges locate an arc of travel for the lid front 78. The first and second lower side walls 30, 34 fix the locations of the back wall flaps 114, 116 with respect to the bottom 18 so that the third and fourth transverse creases 48, 50 are restricted from moving forward toward the lower front wall 38. The first and second lower side walls 30, 34 also fix the location of the front wall 38 with respect to the bottom 18. As such, front corner points 130 on the front wall 38 are located with respect to the inside of the lid front 78. The corner points 130 are located so that they engage the inside of the lid 60 when it is approximately two thirds of the way to being fully closed over the lower box portion 16. This ensures that the force pushing inwardly on the front wall 38 when the lid 60 is fitted to the lower box portion 16 is not so great that it would tend to bow the front wall 38 inward on the contents of the box 10. When the lid 60 is over the lower box portion 16, the back wall flaps 114, 116 are in adjacent contact to the back wall 46, and the front wall 38 is adjacent to the lid front 78. This provides a rigid structure that prevents crushing of the contents therein. When the lid 60 is fitted over the lower box portion 16, the lower window edge 54 of the back wall 46 and the lower window edge 84 of the front wall 78 are aligned at the same height above the bottom 18 of the lower box portion 16. With this alignment, a viewer from outside of the box 10 can see through the portion of the window 75 on the lid front 78 through the portion of the window 75 on the back wall 46 without obstruction when the box is empty. This provides a nearly complete view of the contents of the box 10 when the lid portion 60 is fitted over the lower box portion 16.

For shipping, the box 10 can be flattened to reduce its volume. This is done by bending the angled creases 106 inward so the first lower side wall 30 and second lower side walls 34 collapse inward as shown in FIG. 9. Similarly, this is done with angled creases 124 in the lid portion 60 that allow front lid tabs 126 to bend inwardly about their respective creases 128 adjoining the lid front 78. The box 10 may be completely flattened when the back wall flaps 114, 116 are straightened.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A folding baked goods box comprising:

A lower box portion having a bottom defined by a first transverse crease, a second transverse crease, a first lateral crease, and a second lateral crease, a first lower side wall extending from said first lateral crease and terminating in an upper edge, said first lower side wall foldable to an upstanding position with respect to said bottom, a second lower side wall extending from said second lateral crease and terminating in an upper edge, said second lower side wall foldable to an upstanding position with respect to said bottom, a lower front wall extending from said first transverse crease terminating in a upper edge and having a lower front edge intermediate to said first transverse crease and said upper edge of said lower front wall, said lower front wall including a first lower front wall flap having a bottom facing edge, said first lower front wall flap extending from a fifth lateral crease and foldable to an upstanding position with respect to said lower front wall and a second lower front wall flap having a bottom facing edge, said second lower front wall flap extending from a sixth lateral crease and foldable to an upstanding position with respect to said lower front wall, said first lower front wall flap wall being adhered to said first lower side wall and said second lower front wall flap being adhered to said second lower side wall, a back wall extending from said second transverse crease terminating in a upper edge defined by third and fourth transverse creases, said back wall having a lower window edge intermediate to said third and fourth transverse creases and said second transverse crease, said lower front wall and said back wall foldable to an upstanding position with respect to said bottom, said first and second lower front wall flaps adhered to corresponding said lower side walls within bottom lateral triangular portions within said lower side walls, said bottom lateral triangular portions being formed by an angled crease obliquely angled with respect to said bottom when said lower side walls are upstanding with respect to said bottom and when said lower sidewalls are upstanding with respect to said bottom said bottom facing edges of said first and second lower front wall flaps having an interference fit with said bottom thereby maintaining said lower front wall and said lower side walls in said upstanding positions;

a lid portion hingedly attached to said lower box portion by said third and fourth transverse creases, said lid portion having a top defined by said third and fourth transverse creases, oppositely located fifth and sixth transverse creases, and third and fourth lateral creases, said top including oppositely located lateral window edges located between said third and fourth lateral creases, said lid portion including a lid front extending from said fifth and sixth transverse creases and terminating at a lower edge opposite said fifth and sixth transverse creases, a lid lower window edge located intermediate to said fifth and sixth transverse creases and said lid lower edge, said lid including a first lid side wall extending from said third lateral crease terminating in a lower edge and a second lid side wall extending from said fourth lateral crease and terminating in a lower edge; and a window in said baked goods box continuously extending from said lower window edge of said back wall across said top of said lid portion between lateral window edges to said lid lower window edge of said lid front, said lid portion adapted for being fitted over said lower box portion so that when said lower edge of said lid front aligns with said bottom and overlaps said lower front wall, said lower front edge of said lower front wall does not extend above said lower window edge.

2. The folding baked goods box of claim 1, said first lower side wall including a back flap foldable to an upstanding position with respect to said first lower side wall, said second lower side wall including a back flap foldable to an upstanding position with respect to said second lower side wall, said back flaps of said first and second lower side walls adapted for being in adjacent contact to said back wall adjacent to said window located within said back wall when said back flaps and said lower side walls are in their upstanding positions.

3. The folding baked goods box of claim 1, wherein said lower front wall, said lower side walls and said bottom form substantially perpendicular corners when said bottom lateral triangular portions are substantially coplanar with their corresponding said lower side walls.

4. The folding baked goods box of claim 3, wherein said lid front contacts said upper edge of said lower front wall when said lid is approximately ⅔ closed over said lower box portion.

* * * * *